US006941612B1

(12) United States Patent
Hirse

(10) Patent No.: US 6,941,612 B1
(45) Date of Patent: Sep. 13, 2005

(54) MOP WRINGER

(75) Inventor: Gernot Hirse, Frankfurt am Main (DE)

(73) Assignee: Firma Carl Freudenberg, Weinheim (DE)

( * ) Notice: Subject to any disclaimer, the term of this patent is extended or adjusted under 35 U.S.C. 154(b) by 0 days.

(21) Appl. No.: 09/720,321

(22) PCT Filed: May 27, 1999

(86) PCT No.: PCT/EP99/03666

§ 371 (c)(1),
(2), (4) Date: Jul. 9, 2001

(87) PCT Pub. No.: WO99/66825

PCT Pub. Date: Dec. 29, 1999

(30) Foreign Application Priority Data

Jun. 23, 1998 (DE) ..... 198 27 865

(51) Int. Cl.[7] ..... A47L 13/59
(52) U.S. Cl. ..... 15/261
(58) Field of Search ..... 15/261, 260

(56) References Cited

U.S. PATENT DOCUMENTS 1,500,058 A 7/1924 Courtemanche
2,246,394 A * 6/1941 Steele
2,926,377 A 3/1960 Hollander
4,047,261 A 9/1977 Rones

FOREIGN PATENT DOCUMENTS

| | | |
|---|---|---|
| DE | 94 13 604 | 12/1995 |
| EP | 0 824 008 | 2/1998 |
| GB | 2 242 825 | 10/1991 |

* cited by examiner

*Primary Examiner*—Randall E. Chin
(74) *Attorney, Agent, or Firm*—Kenyon & Kenyon

(57) ABSTRACT

A mop wringer for a device for cleaning wet floors has a fixed squeezing plate which is positioned between wringer sidewalls. A movable squeezing plate is pivoted to the sidewalls. An actuating lever is configured as a two-armed lever with a shorter lever arm and a longer arm. The actuating lever is connected to the movable squeezing plate by the shorter lever arm and a push guide. A pressing action is carried out by pivoting the actuating lever away from the movable squeezing plate. In the final pressing position, the push guide forms an almost extended toggle lever joint with the shorter lever arm.

10 Claims, 2 Drawing Sheets

MOP WRINGER

FIELD OF THE INVENTION

The present invention relates to a mop wringer for a device for cleaning wet floors. In particular, the invention relates to a mop wringer having a fixed squeezing plate connected to sidewalls of the wringer and having a pivoted, movable squeezing plate engaged with a push guide which is connected to an actuating lever mounted on the wringer sidewalls.

BACKGROUND OF THE INVENTION

Mop wringers are used to wring out absorbent, water-saturated mop material. Typically, mop wringers are placed at the top of a water container which is open at the top and holds the cleaning water, or they form a unit with such a container.

The mop to be wrung out is placed from above in an open pressing space between a fixed squeezing plate and a movable squeezing plate. To wring out the mop, the movable squeezing plate is pressed toward the fixed squeezing plate by a swiveling motion of the actuating lever.

In the case of a known mop wringer (disclosed in EP 824 008 A2), the movable squeezing plate is moved horizontally and in parallel.

For this purpose, guideways are provided in the sidewalls of the wringer. The actuating lever is attached on one end to the wringer sidewalls. At a distance from this attachment, a push guide, which is attached to the backside of the moveable squeezing plate, is pivotingly attached to the actuating lever. In response to a swiveling motion of the actuating lever towards the movable squeezing plate, the movable squeezing plate is pushed against the fixed squeezing plate by the push guide, in order to wring out the mop therebetween.

In the case of another mop wringer of the species defined at the outset (DE-GM 94 13 604), the movable squeezing plate performs a pivoting motion. The actuating lever is mounted on the outside of one wringer sidewall and is connected to a rocking shaft which connects both wringer sidewalls. A lever, which is fastened to the rocking shaft between the two wringer sidewalls, is hinged to the push guide, which is engaged with the squeezing plate.

Both known mop wringers have the common feature that in the starting position, the actuating lever slants away from the squeezing plates and is tilted in a vertical position towards the squeezing plates when performing a pressing action. Thus, the actuating force exerted on the actuating lever essentially occurs almost horizontally. In this context, the water container holding the mop wringer must be sufficiently heavy and/or steady to prevent the container from tipping over as a result of this horizontal force. Therefore, such mop wringers can only be placed on water containers which form part of a sufficiently heavy cleaning cart. Thus, such mop wringers are not appropriate for use on light, portable water containers, such as cleaning buckets.

It is also not possible to satisfactorily solve this problem by changing the starting position of the actuating lever, since the actuating lever must be laterally mounted on the outside of the wringer sidewalls as a result of its predefined actuating direction. Every actuating force exerted on the actuating lever is so far off-center in relation to the water container that a tipping force is exerted on the water container.

The object of the present invention is to design a mop wringer in such a way that the actuating force exerted on the actuating lever does not exert any significant tipping force on the water container carrying the mop wringer.

SUMMARY OF THE INVENTION

In accordance with the present invention, this object is achieved by designing the actuating lever as a two-armed lever with a shorter lever arm and a longer arm. The shorter lever arm is hinged at its free end to the push guide in such a way that tilting the longer arm of the actuating lever away from the movable squeezing plate tilts the movable squeezing plate towards the fixed squeezing plate.

Because the swiveling motion of the actuating lever is directed away from the movable squeezing plate, the movement of the lever is neither hindered by the squeezing plates nor by the handle of the mop therebetween. Thus, the actuating lever can be symmetrically mounted on the mop wringer so that no one-sided tipping forces are exerted on the water container. Since sufficient space is available outside of the mop wringer for tilting the actuating lever, the direction of the actuating force can be designed in such a way that it is essentially directed downward, i.e., towards the base of the water container, and, therefore, also does not exert a tipping force on the water container. As such, the mop wringer can also be mounted on light, portable water containers, e.g., cleaning buckets, and used without danger, thereby making it also suitable for household use.

DETAILED DESCRIPTION OF THE INVENTION

Figure 1:
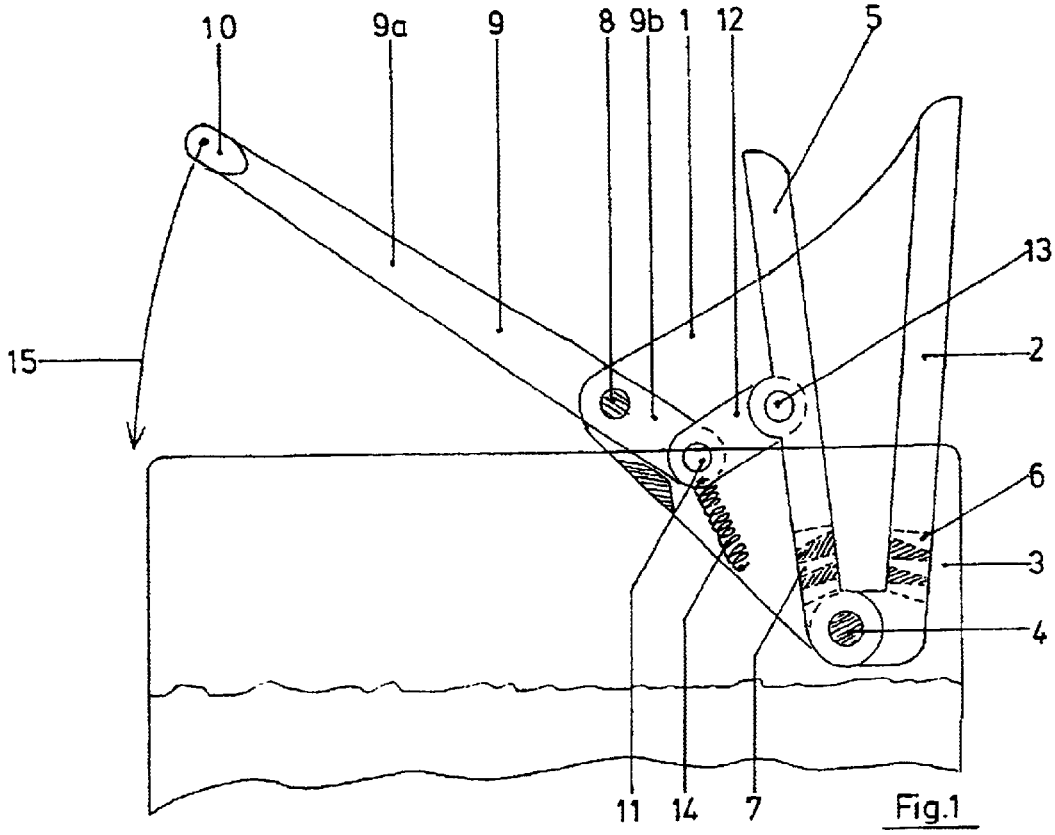
FIG. 1 shows a simplified vertical longitudinal section of a mop wringer in the starting position.
Figure 2:
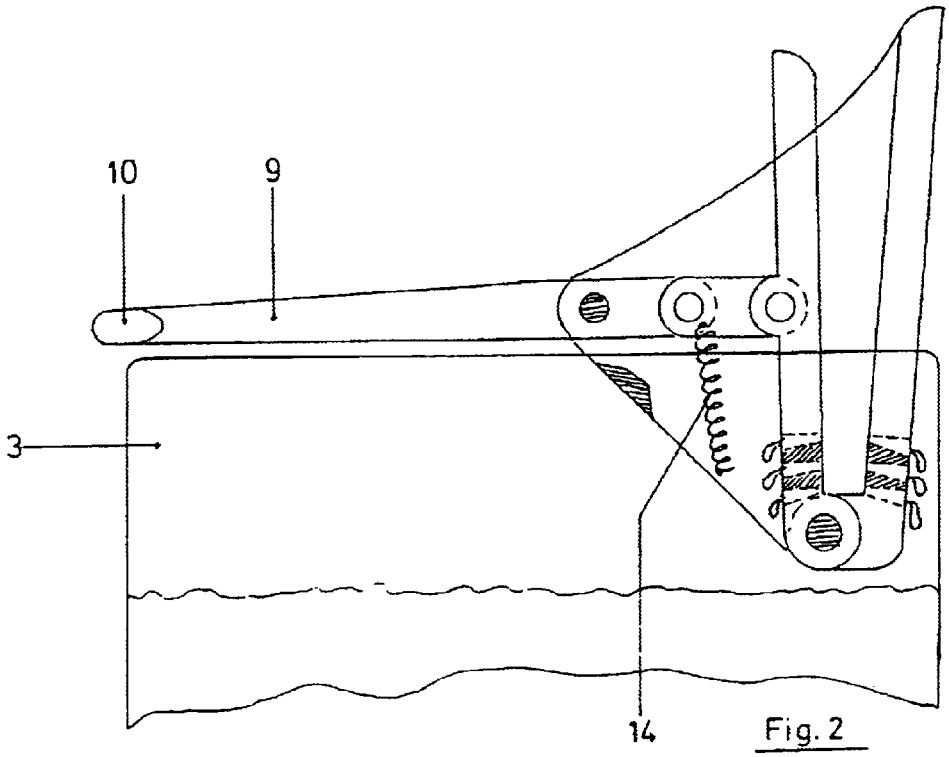
FIG. 2 shows the mop wringer according to FIG. 1 in the final pressing position.

An exemplary embodiment of the mop wringer illustrated in FIGS. 1 and 2 is used for wringing out a mop (not shown) of a device for cleaning wet floors. In this context, the mop preferably has a hard, flat center having a wringable mop covering on both sides. A squeezing plate 2 is securely attached between two wringer sidewalls 1, which are arranged at a distance to one another. The wringer sidewalls 1 are mounted on the top edge of a water container 3, e.g., a cleaning bucket, or securely attached to the water container 3.

On its bottom edge, the fixed squeezing plate 2 is provided with a hinged bearing 4. A movable squeezing plate 5 is pivoted to the hinged bearing 4. The two squeezing plates 2 and 5 are provided with perforations 6 and 7, respectively, and/or run-off grooves or the like. The water wrung out of the mop can exit and flow back into water container 3 through the perforations 6, 7. When being pressed, the squeezing plates 2 and 5 are preferably almost vertical.

An actuating lever 9, which is designed as a two-armed lever, is pivotingly attached to a hinged bearing 8 on the wringer sidewalls 1. In the starting position illustrated in FIG. 1, the actuating lever 9 assumes a slant-wise rising position. At the unattached end of a longer lever arm 9*a*, the actuating lever 9 forms a handle 10. A shorter lever arm 9*b* of the actuating lever 9 is connected at its unattached end by a hinged bearing 11 to a push guide 12. The push guide 12 is engaged with a hinged bearing 13 on the backside of the movable squeezing plate 5.

An extension spring 14 is fastened to the wringer sidewalls 1, and engages from below with the region of hinged bearing 11, which connects the shorter lever arm 9*b* to push guide 12. The extension spring forms a return spring by which the actuating lever 9 is moved to the starting position illustrated in FIG. 1.

The actuating lever 9 can be designed as a one-part, straight lever. On the other hand, it is also feasible for the actuating lever 9 to have a two-part design so that two parallel legs are connected by a transversely running handle 10 to form a U-shaped bow piece.

After the mop to be wrung out has been introduced into the space between the squeezing plates 2 and 5, the actuating lever 9, which is in the starting position illustrated in FIG. 1, is pressed down in the direction of arrow 15. By tilting the longer arm 9*a* of the actuating lever away from the movable squeezing plate 5, the movable squeezing plate 5 is tilted towards the fixed squeezing plate 2, thereby exerting a squeezing effect on the mop. In the final pressing position shown in FIG. 2, the push guide 12 forms an almost extended toggle lever joint with the shorter lever arm 9*b*. Therefore, the compression force exerted on the mop increases progressively during the pressing operation. In the pressing end position, the actuating lever 9 assumes an almost horizontal position and lies, for example, on the top edge of the water container 3, as shown in FIG. 2. If the handle 10 of the actuating lever is released, the return spring 14 returns the mop wringer to the starting position illustrated in FIG. 1.

Figure 3:
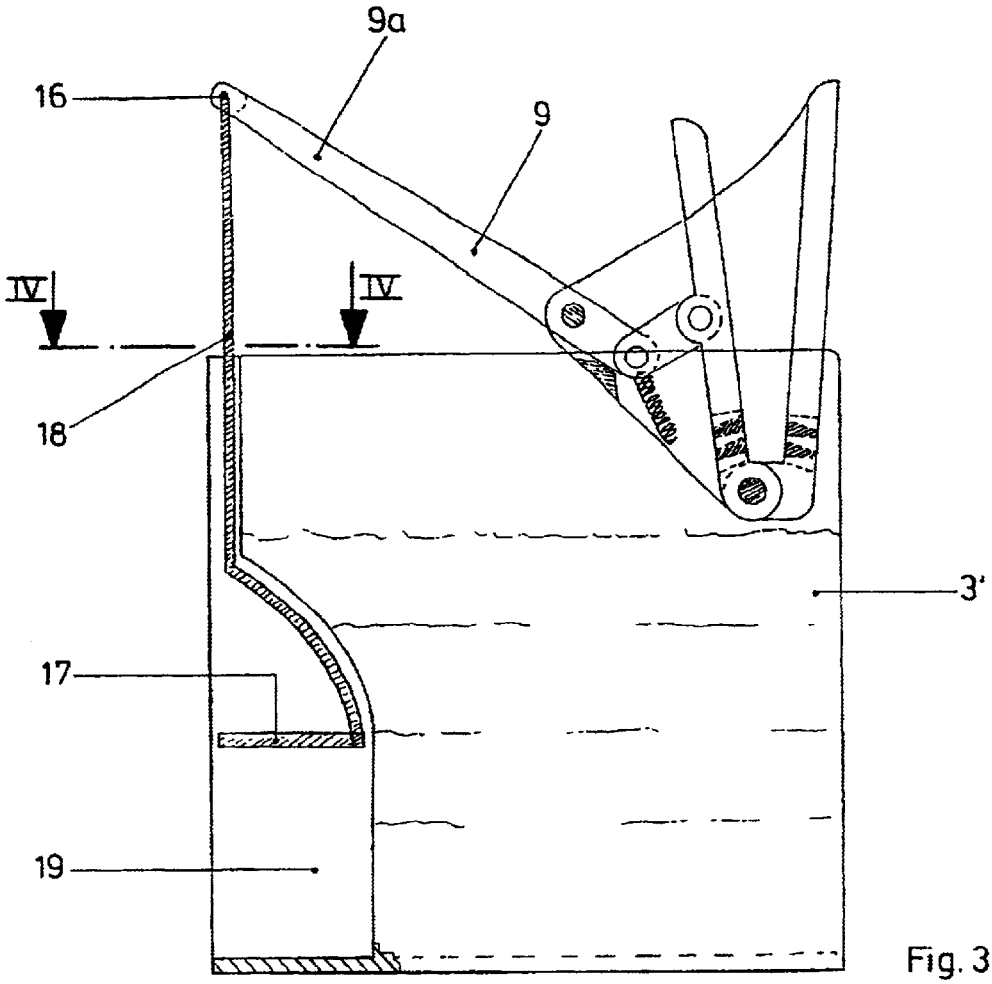
FIG. 3 shows a section corresponding to FIG. 1 of a transformed refinement of a foot-operated mop wringer.
Figure 4:
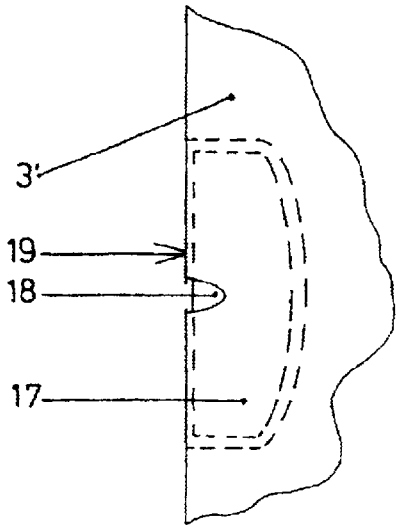
FIG. 4 shows part of a section along the line IV—IV in FIG. 3.

The exemplary embodiment shown in FIGS. 3 and 4 differs from the exemplary embodiment according to FIGS. 1 and 2 only in how the actuating force is exerted on the longer arm 9*a* of the actuating lever 9.

In this embodiment, a hinged bearing 16 connects the unattached end of the longer lever arm 9*a* of the actuating lever 9 to a vertical rod 18. The vertical rod-18 is connected to a foot-actuated, stirrup-shaped pedal 17. The pedal 17 is arranged to move up and down in a lateral recess 19 in the water container 3', which includes the mop.

What I claim is:

1. A mop wringer for device for cleaning wet floors comprising:

wringer sidewalls;

a fixed squeezing plate attached to the wringer sidewalls;

a pivoted, movable squeezing plate attached to the wringer sidewalls;

a push guide engaged with the movable squeezing plate; and an actuating lever pivotably attached to the wringer sidewalls at an attachment location and connected to the push guide, wherein the actuating lever is a two-armed lever with a shorter level arm arranged on a first side of the attachment location and a longer arm arranged on a second side of the attachment location opposite the first side, and the shorter lever arm is hinged at a free end to the push guide so that in response to a swivel motion of the longer arm of the actuating lever away from the movable squeezing plate, the movable squeezing plate is tilted towards the fixed squeezing plate.

2. The mop wringer as recited in claim 1, wherein in the final pressing position, the push guide forms an almost extended toggle lever joint with the shorter lever arm of the actuating lever.

3. The mop wringer as recited in claim 1, wherein the actuating lever assumes a slant-wise rising position in the starting position.

4. The mop wringer as recited in claim 1, wherein the actuating lever is moved to the starting position by an extension spring.

5. The mop wringer as recited in claim 1, wherein the actuating lever forms a handle at the unattached end of the longer lever arm.

6. The mop wringer as recited in claim 1, wherein the actuating lever has a two-part design forming two parallel legs, and the parallel legs are connected by a transversely running handle to form a U-shaped bow piece.

7. The mop wringer as recited in claim 1, wherein the unattached end of the longer lever arm of the actuating lever is connected to a foot-actuatable, stirrup-shaped pedal.

8. A mop wringer for a device for cleaning wet floors comprising:

wringer sidewalls;

a fixed squeezing plate attached to the wringer sidewalls;

a pivoted, movable squeezing plate attached to the wringer sidewalls;

a push guide engaged with the movable squeezing plate; and an actuating lever pivotably attached to the wringer sidewalls at an attachment location and connected to the push guide, wherein the actuating lever is a two-armed lever with a shorter lever arm arranged on a first side of the attachment location and a longer arm arranged on a second side of the attachment location opposite the first side, and the shorter lever arm is hinged at a free end to the push guide so that in response to a swivel motion of the longer arm of the actuating lever away from the movable squeezing plate, the movable squeezing plate is tilted towards the fixed squeezing plate, wherein the actuating lever assumes a nearly horizontal position in the final pressing position.

9. A mop wringer for a device for cleaning wet floors comprising:

wringer sidewalls;

a fixed squeezing plate attached to the wringer sidewalls;

a pivoted, movable squeezing plate attached to the wringer sidewalls;

a push guide engaged with the movable squeezing plate; and an actuating lever pivotably attached to the wringer sidewalls and connected to the push guide, wherein the actuating lever is a two-armed lever with a shorter lever arm and a longer arm, and the shorter lever arm in hinged at a free end to the push guide so that in response to a swivel motion of the longer arm of the actuating lever away from the movable squeezing plate, the movable squeezing plate is tilted towards the fixed squeezing plate;

wherein the actuating lever is moved to the starting position by an extension spring; and wherein the extension spring is fastened to wringer sidewalls, and engages from below in the region of a hinged bearing, said bearing connecting the shorter lever arm to the push guide.

10. A mop wringer for a device for cleaning wet floors comprising:

wringer sidewalls;

a fixed squeezing plate attached to the wringer sidewalls;

a pivoted, movable squeezing plate attached to the wringer sidewalls;

a push guide engaged with the movable squeezing plate; and an actuating lever pivotably attached to the wringer sidewalls and connected to the push guide, wherein the actuating lever is a two-armed lever with a shorter lever arm and a longer arm, and the shorter lever arm is hinged at a free end to the push guide so that in response to a swivel motion of the longer arm of the actuating lever away from the movable squeezing plate, the movable squeezing plate is tilted towards the fixed squeezing plate;

wherein the unattached end of the longer lever arm of the actuating lever is connected to a foot-actuatable, stirrup-shaped pedal; and wherein the pedal is arranged to move up and down in a lateral recess in a water container.

* * * * *